US010046210B1

(12) United States Patent
Vora et al.

(10) Patent No.: US 10,046,210 B1
(45) Date of Patent: Aug. 14, 2018

(54) GOLF BALL INCORPORATING PAIR OF THIN HEMISPHERICAL CUPS HAVING TARGETED CONFIGURATION/GEOMETRY AND BEING COMPRESSION MOLDED ABOUT LARGE, SOFT SUBASSEMBLY/CORE

(71) Applicant: Acushnet Company, Fairhaven, MA (US)

(72) Inventors: Ajay Vora, Foxboro, MA (US); Donald A. Serino, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/603,672

(22) Filed: May 24, 2017

(51) Int. Cl.
*A63B 37/06* (2006.01)
*A63B 45/00* (2006.01)
*A63B 37/00* (2006.01)

(52) U.S. Cl.
CPC ..... *A63B 45/00* (2013.01); *A63B 37/008* (2013.01); *A63B 37/0031* (2013.01); *A63B 37/0033* (2013.01); *A63B 37/0036* (2013.01); *A63B 37/0064* (2013.01); *A63B 37/0065* (2013.01); *A63B 37/0078* (2013.01)

(58) Field of Classification Search
USPC ..... 473/351–378
See application file for complete search history.

(56) References Cited

U.S. PATENT DOCUMENTS 4,556,220 A * 12/1985 Tominaga ..... A63B 37/0003 260/998.14
4,561,657 A * 12/1985 Tominaga ..... A63B 37/0003 260/998.14
4,959,000 A 9/1990 Giza
5,147,657 A 9/1992 Giza
5,150,906 A * 9/1992 Molitor ..... A63B 37/0003 156/145
5,492,972 A * 2/1996 Stefani ..... A63B 37/0003 428/402
5,656,695 A * 8/1997 Endo ..... A63B 37/0003 473/372
5,721,319 A * 2/1998 Dalton ..... A63B 37/0003 273/DIG. 22
5,798,071 A * 8/1998 Boehm ..... B29C 33/123 264/271.1

(Continued)

*Primary Examiner* — Alvin Hunter
(74) *Attorney, Agent, or Firm* — Margaret C. Barker

(57) ABSTRACT

Golf ball having CoR of at least 0.700 and comprising: a substantially spherical subassembly having diameter of 1.3 inches or greater and compression of from about 15-60; and a thin outer layer having a compression molded thickness of about 0.015-0.055 inches and consisting of first and second hemispherical cups consisting of a polymer composition having a melt flow index at 190° C. under a 2.16-kg load of from about 0.8 g/10 min. to about 4 g/10 min. and having a cup thickness ratio of from about 1.10 to 1.70 as well as an inner surface that is sized, shaped and contoured to receive and conformally and adhesively mate onto and about the subassembly during compression molding such that the subassembly in the finished golf ball is substantially spherical and disposed concentrically within the thin outer layer. Also, the novel hemispherical cups and the method of making the golf ball.

26 Claims, 2 Drawing Sheets

(56) References Cited

U.S. PATENT DOCUMENTS 5,994,470 A * 11/1999 Tanaka ..... A63B 37/0003 473/354
6,036,907 A * 3/2000 Tanaka ..... B29C 43/18 264/248
6,093,357 A * 7/2000 Bissonette ..... A63B 37/0003 264/248
6,096,255 A * 8/2000 Brown ..... A63B 37/0003 156/228
6,180,040 B1 * 1/2001 Ladd ..... B29C 43/146 264/248
6,207,095 B1 * 3/2001 Gosetti ..... B29C 43/146 264/250
6,218,453 B1 4/2001 Boehm et al.
6,254,495 B1 * 7/2001 Nakamura ..... A63B 37/04 473/371
6,290,797 B1 * 9/2001 Gosetti ..... A63B 37/0039 156/228
6,299,550 B1 * 10/2001 Molitor ..... A63B 37/0003 473/354
6,431,998 B1 * 8/2002 Nakamura ..... A63B 37/0003 473/371
6,461,251 B1 * 10/2002 Yamagishi ..... A63B 37/0003 473/376
6,468,381 B1 * 10/2002 Morgan ..... A63B 37/0003 156/244.19
6,517,451 B2 2/2003 Carvallaro et al.
6,635,133 B1 * 10/2003 Boehm ..... A63B 37/0076 156/146
6,802,785 B2 * 10/2004 Jordan ..... A63B 37/0003 473/378
6,855,071 B2 * 2/2005 Endo ..... A63B 37/0003 473/355
7,005,098 B2 * 2/2006 Cavallaro ..... A63B 45/00 264/248
7,086,969 B2 * 8/2006 Higuchi ..... A63B 37/0031 473/376
7,267,624 B2 * 9/2007 Tapper ..... A63B 37/0004 473/383
7,351,166 B2 * 4/2008 Cavallaro ..... A63B 45/00 473/376
7,927,524 B2 4/2011 Vora et al.
8,309,002 B2 11/2012 Vora et al.
8,865,045 B2 * 10/2014 Binette ..... A63B 37/0004 264/279.1
8,883,062 B2 * 11/2014 Binette ..... A63B 37/0004 264/279.1
9,474,939 B2 * 10/2016 Cheng ..... B29C 49/46
2003/0100386 A1 5/2003 Jordan
2004/0048687 A1 3/2004 Jordan
2004/0080080 A1 4/2004 Dalton et al.
2004/0157681 A1 8/2004 Lemons et al.
2005/0037866 A1 2/2005 Emerson et al.
2005/0159247 A1 7/2005 Lemons et al.
2006/0073913 A1 4/2006 Castner
2010/0087227 A1 4/2010 Ogg et al.
2010/0087274 A1 4/2010 Ogg et al.
2011/0130217 A1 6/2011 Ogg et al.
2012/0077620 A1 3/2012 Ogg et al.
2013/0072323 A1 3/2013 Lin
2013/0140734 A1 6/2013 Chou et al.
2013/0172105 A1 7/2013 Ishii et al.
2014/0054819 A1 2/2014 Lin
2015/0367179 A1 12/2015 Farrell et al.
2015/0367180 A1 12/2015 Farrell et al.
2015/0367181 A1 12/2015 Farrell et al.

* cited by examiner

GOLF BALL INCORPORATING PAIR OF THIN HEMISPHERICAL CUPS HAVING TARGETED CONFIGURATION/GEOMETRY AND BEING COMPRESSION MOLDED ABOUT LARGE, SOFT SUBASSEMBLY/CORE

FIELD OF THE INVENTION

The present invention generally relates to golf balls incorporating a thin outer layer compression molded onto and about a large and soft core/subassembly, and methods of making same.

BACKGROUND OF THE INVENTION

Conventional golf balls can be divided into two general classes: solid and wound. Solid golf balls include one-piece, two-piece (i.e., single layer core and single layer cover), and multi-layer (i.e., solid core of one or more layers and/or a cover of one or more layers) golf balls. Wound golf balls typically include a solid, hollow, or fluid-filled center, surrounded by a tensioned elastomeric material, and a cover.

Examples of golf ball materials range from rubber materials, such as balata, styrene butadiene, polybutadiene, or polyisoprene, to thermoplastic or thermoset resins such as ionomers, polyolefins, polyamides, polyesters, polyurethanes, polyureas and/or polyurethane/polyurea hybrids, and blends thereof. From the perspective of a golf ball manufacturer, it is desirable to have materials exhibiting a wide range of properties, such as resilience, durability, spin, and "feel," because this enables the manufacturer to make and sell golf balls suited to differing levels of ability and/or preferences. In this regard, playing characteristics of golf balls, such as spin, feel, CoR and compression can be tailored by varying the properties of the golf ball materials and/or adding additional golf ball layers such as at least one intermediate layer disposed between the cover and the core. Intermediate layers can be of solid construction, and have also been formed of a tensioned elastomeric winding. The difference in play characteristics resulting from these different types of constructions can be quite significant.

Conventionally, golf balls are made by molding outer layers about a core. Typically, outer layers are formed about the spherical outer surface of an innermost golf ball layer via compression molding, casting, or injection molding. Injection molding typically requires a mold having at least one pair of mold cavities; e.g., a first mold cavity and a second mold cavity, which mate to form a spherical recess. In addition, a mold may include more than one mold cavity pair. In one injection molding process, each mold cavity includes retractable positioning pins to hold the core in the spherical center of the mold cavity pair. Once the core is positioned in the first mold cavity, the respective second mold cavity is mated to the first to close the mold. A cover material is then injected into the closed mold. The positioning pins are retracted while the cover material is flowable to allow the material to fill in any holes caused by the pins. When the material is at least partially cured, the covered core is removed from the mold (de-molded).

Casting is a common method of producing a urethane, urea or urethane/urea hybrid outer layer about a core or other subassembly. A desired benefit of casting golf ball layers about subassemblies is that the resulting layer has a substantially uniform thickness. In a casting process, a castable composition is introduced into a first mold cavity of a given pair of mold half shells. The core/subassembly is then either placed directly into the composition or is held in position (e.g., by an overhanging vacuum or suction apparatus) to contact the material in what will be the spherical center of the mold cavity pair. Once the castable composition is at least partially cured (e.g., to a point where the core will not substantially move), additional castable composition is introduced into a second mold cavity of each pair, and the mold is closed. The closed mold is then subjected to heat and pressure to cure the composition, thereby forming the outer layer about the core. The mold cavities can have smooth surfaces or include a negative dimple pattern to impart dimples in the composition during the molding process where the cast layer is a cover, for example. It is important that a core/subassembly be centered in the castable composition within a mold cavity before the mold halves are mated because a non-centered core/subassembly can create and result in undesirable playing characteristics.

Compression molding or retractable pin injection molding (RPIM) are methods commonly used to form ionomer covers around solid or dual polybutadiene (PBD) cores. Compression molding involves using multiple pairs of hemispherical cups with respective cavities which when combined form a spherical recess for receiving and housing the core. The pair of hemispherical cups are placed into compression mold cavities and closed about the core which is placed between the hemispherical cups. The core and cover combination is then exposed to heat and pressure, which cause the hemispherical cups to combine and form a full cover.

However, it is well known in the art that compression molding a thin cover over a large and/or soft core can cause a "blow out" of the core due to severe deformation of the soft core as the mold is closed. Also, it is very difficult to obtain acceptable roundness of the molded golf ball especially with softer (25-70 Atti/PGA) and larger cores (greater than 1.530"). Excessive core shifting is another major issue encountered. Similar issues have been experienced with RPIM technology due to forces resulting from "pinching" of retractable pins to hold softer polybutadiene (PBD) cores in the center and "hard to control" multi-directional plastic fluid forces during injection will greatly shift PBD cores as well as produce unacceptable out-of-round product. Variations in final golf ball characteristics such as compression, weight, size, roundness, and layer adhesion therefore occur.

Consequently, a practice called "bumping" has been used in the production of compression molding about PBD cores in order to aid in releasing residual air in the mold cavity. With this technique, the mold is clamped for a short time (at least 15 seconds), and then unclamped to allow the residual air to release. This became standard practice in compression molding for over twenty years and is described in U.S. Pat. No. 6,838,036 of Sugimoto.

More recently, improvements have been directed to making the steps of a compression molding process more controllable. For example, one advance replaces pre-set cycle times with instrumentation for monitoring the compression molding press, its molds and tooling, along with its facilities, to gather and use feedback from the process to actively dictate press movement and to time the process in order to produce a more consistent product. See U.S. Pat. No. 7,927,524 ("'524 patent") and U.S. Pat. No. 8,309,002 ("'002 patent") of Vora et al., each hereby incorporated by reference herein in its entirety.

Despite being better able to control the steps of the compression molding process, numerous instances of "blowout" and "cup shifting" have continued to occur when compression molding a thin cover/outer layer over a large and soft core. And unfortunately, when blowout occurs, it rarely happens in a single or merely a few instances but rather with respect to many if not most of the cores involved in the run.

For example, ionomer blends containing higher levels of FUSABOND® (e.g., about 20-35 wt. %) can deliver soft feel and distance but tend to produce such blowout when incorporated in conventional compression molding cups that are compression molded over large, soft cores. As a result, golf ball manufacturers have instead turned to alternatives such as very low modulus ionomers (VLMI), which provide soft feel, but not the distance that an ionomer blend containing FUSABOND® in amounts of about 20-35 wt. % could.

It would therefore be beneficial to develop improvements to the configuration and geometry of the hemispherical molding cups themselves in order to expand and extend options for compression moldable materials to include desirable compositions such as ionomer/FUSABOND® blends containing up to 20%-35% or greater FUSABOND®. Such improved hemispherical cups would be particularly useful if useable within existing compression molding processes after small tooling modifications and without meanwhile sacrificing desirable playing characteristics typically produced by such golf balls, namely soft feel accompanied by good distance.

The current inventive golf balls incorporating novel hemispherical cups and methods of making such golf balls address and solve these needs.

SUMMARY OF THE INVENTION

Accordingly, a golf ball of the invention includes a thin outer layer that is constructed of first and second hemispherical cups having a configuration and geometry sufficient to be compression molded about a large, very soft core or other subassembly without any fear of "blow out" of the core/subassmebly material or of cup shifting. In one embodiment, a golf ball of the invention has a CoR of at least 0.700 and comprises: a substantially spherical subassembly having a diameter of 1.3 inches or greater and a compression of from about 15 to about 60; and a thin outer layer consisting of first and second hemispherical cups that are compression molded about the substantially spherical subassembly; wherein each hemispherical cup consists of a polymer composition having a melt flow index at 190° C. under a 2.16-kg load of from about 0.8 g/10 min. to about 4 g/10 min. and has: (i) a thickness that tapers from a top section to a bottom section such that a cup thickness ratio of a top section thickness to a bottom section thickness is from about 1.10 to 1.70; and (ii) an inner surface that is sized, shaped and contoured to receive and conformally and adhesively mate onto and about the subassembly during compression molding such that the substantially spherical subassembly has a substantially spherical shape after compression molding and is disposed concentrically within the outer layer.

In a particular embodiment, the subassembly comprises polybutadiene rubber, and The polymer composition consists of an ionomer composition comprising at least one of metallocene-catalyzed polyethylenes, functionalized ethylene acrylate copolymers, functionalized ethylene vinyl acetate copolymers, anhydride modified HDPEs, random ethylene copolymers, chemically modified ethylene elastomers, or functionalized polypropylenes in an amount of from about 20 wt. % to about 35 wt. % of the total weight of the ionomer composition.

In one such embodiment, the subassembly is a core having a diameter of at least 1.50 inches and a compression of from about 25 to 60; the outer layer is a cover having a molded thickness of from about 0.020 inches to 0.055 inches; and the cup thickness ratio is from about 1.40 to 1.70. In this embodiment, a ratio of the top section thickness to a uniform thickness of the cover may be 1.50 to 2.7.

In another embodiment, the core has a diameter of at least 1.30 inches and a compression of from about 25 to 60; and the outer layer is a casing layer having a molded thickness of from 0.015 inches to about 0.055 inches; and the cup thickness ratio is from about 1.10 to 1.70. In this embodiment, a ratio of the top section thickness to a uniform thickness of the casing layer may be 1.30 to 2.5.

In one embodiment, the outer layer has a Shore D hardness of at least 60. In another embodiment, the outer layer has a Shore D hardness of less than 65.

In a specific embodiment, the ionomer composition comprises at least one ethylene-methacrylic acid co-polymer.

The invention also relates to the first and second hemispherical cups themselves. The first and second hemispherical cups each consist of a polymer composition having a melt flow index at 190° C. under a 2.16-kg load of from about 0.8 g/10 min. to about 4 g/10 min. and have (i) a cup thickness that tapers from a top section to a bottom section such that a cup thickness ratio of a top section thickness to a bottom section thickness is from about 1.10 to 1.70; and (ii) an inner surface that is sized, shaped and contoured to receive and conformally and adhesively compression mold onto and about a substantially spherical subassembly having a diameter of at least 1.3 inches and a compression of from about 15 to about 60 such that the subassembly has a substantially spherical shape after compression molding and is disposed concentrically within the compression molded first and second hemispherical cups.

Meanwhile, the invention relates to a method of making a golf ball of the invention having a CoR of at least 0.700 comprising the steps of: (a) providing a substantially spherical subassembly having a diameter of 1.3 inches or greater and a compression of from about 15 to about 60; (b) providing first and second hemispherical cups, each hemispherical cup consisting of a polymer composition having a melt flow index at 190° C. under a 2.16-kg load of from about 0.8 g/10 min. to about 4 g/10 min. and having: (i) a thickness that tapers from a top section to a bottom section such that a cup thickness ratio of a top section thickness to a bottom section thickness is from about 1.10 inches to 1.70 inches; and (ii) an inner surface that is sized, shaped and contoured to receive and conformally and adhesively mate onto and about the subassembly during compression molding such that the substantially spherical subassembly has a substantially spherical shape after compression molding and is disposed concentrically within the outer layer; and (c) compression molding the first and second hemispherical cups about the substantially spherical subassembly and forming an thin outer layer there about having a compression molded thickness of from about 0.015 inches to about 0.055 inches.

Once again, in specific embodiments, the cup thickness ratio may be from about 1.40 to 1.70, while a ratio of the top section thickness to a uniform thickness of the cover is 1.50 to 2.7. Alternatively, the cup thickness ratio may be from about 1.10 to 1.70, while a ratio of the top section thickness to a uniform thickness of the casing layer is 1.30 to 2.5.

BRIEF DESCRIPTION OF THE DRAWINGS

The accompanying drawings form a part of the specification and are to be read in conjunction therewith. The illustrated embodiments, however, are merely examples and are not intended to be limiting. Like reference numerals and designations in the various drawings indicate like elements.

DETAILED DESCRIPTION

The present invention addresses and solves the problems of core/subassembly blowout and molding cup shifting that continues to occur when forming thin outer layers about large, soft cores/subassemblies despite the availability of systems which better control the compression molding process. Advantageously, in golf balls of the invention and methods of making same, thin hemispherical cups having a targeted configuration and geometry may be compression molded about large, soft cores without fear of blowout or molding cup shifting.

Specifically, in a golf ball of the invention, first and second hemispherical cups each consist of a polymer composition having a melt flow index in the range of from about 0.8 g/10 min. to about 4.0 g/10 min. in accordance with ASTM D-1238, condition E, at 190° C., using a 2160 gram (or 2.16 kg) weight. In other embodiments, the melt flow index is from about 0.8 g/10 min. to about 3.0 g/10 min., or from about 0.8 g/10 min. to about 2.0 g/10 min., or from about 1.5 g/10 min. to about 3.5 g/10 min., or from about 2.0 g/10 min. to about 4.0 g/10 min.

Figure 1:
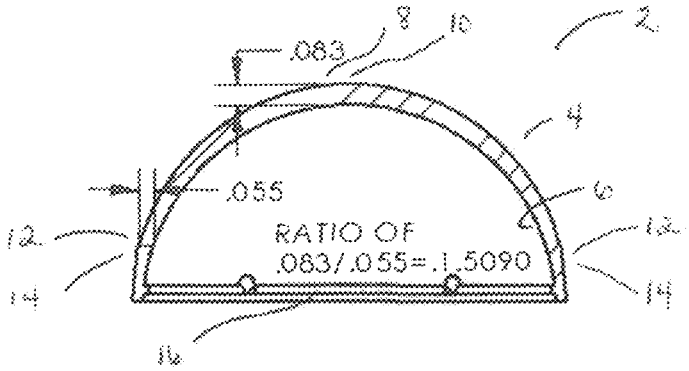
FIG. 1 is a schematic cross-sectional view of a thin hemispherical cup of the invention according to one embodiment of the invention.

Additionally, the first and second hemispherical cups have a thickness that tapers from a top section to a bottom section, and meanwhile, a cup thickness ratio of a top section thickness to a bottom section thickness is from about 1.10 to 1.70. Meanwhile, the top section thickness may be any thickness which, when coordinated with the bottom section thickness in the ratios defined herein, may be compression molded about the large, soft subassembly/core as a resulting outer layer having a uniform compression molded thickness of from about 0.015 inches to about 0.055 inches. And consistent with the cup thickness ratio, the bottom section thickness is always less than the top section thickness. FIG. 1 and accompanying discussion thereof herein reveal one possible inventive hemispherical cup construction wherein the top section thickness is 0.083 inches and the bottom section thickness is 0.055 inches and the resulting cup thickness ratio is therefore (0.083/0.055) or 1.5090.

Cup back pressure is desirably maintained to avoid distortion/sink and minimize displacement of the core/subassembly material at the top section. The stress/dynamic forces typically exerted on a core/subassembly during every step of compression molding are thereby reduced sufficiently to avoid the fear of subassembly/core blowouts and lack of concentricity that can occur when compression molding thin conventional cups about large, low compression subassembly/cores.

The hemispherical cups of the invention can be cost effectively used within existing compression molding systems with minimal tooling modifications to those parts of the system which receive, hold/support and transfer the hemispherical cups during golf ball manufacturing of a compression molded golf ball of the invention. In this regard, FIG. 1, FIG. 2, FIG. 3A and FIG. 3B highlight some of the features of the inventive golf balls and hemispherical cups of the invention but should not be construed as limiting the scope of the invention.

In particular, FIG. 1 illustrates a schematic cross-sectional view of one possible hemispherical cup construction and geometry. Referring to FIG. 1, schematic hemispherical cup 2 includes outer surface 4 and inner surface 6. Top section 8 is located just off center from gate vestige 10 of hemispherical cup 2 between outer surface 4 and inner surface 6 and extends circumferentially about gate vestige 10.

The term "gate vestige", as used herein, is well known in the golf ball art as the typically needle-like shaped vestige or remnant that generally appears at the gate zone of an injection molded hemispherical cup and located on the outer surface thereof at its apex or on a pole. The gate vestige is a separation phenomenon between the runner and the resulting hemispherical cup, and the size and shape of the vestige depends at least in part on the shape of the gate (mold design) and the processing parameters. Attempts to minimize gate vestige have been attempted by using various valve gates, for example, but continue to occur. Gate vestiges are machined off of the golf ball, typically once hemispherical cups 2 are placed or compression molded about the large, soft core 22 (shown in FIGS. 3A and 3B). Gate vestiges are referred to, for example, in U.S. Pat. Nos. 4,959,000 and 5,147,659 of Giza.

Meanwhile, bottom section 12 of hemispherical cup 2 is located just above base 14 and extends between outer surface 4 and inner surface 6 and circumferentially about base 14.

The thickness of each hemispherical cup 2 tapers from top section 8 to bottom section 12 such that a cup thickness ratio of top section thickness to bottom section thickness is from about 1.10 to 1.70. Meanwhile, inner surface 6 is sized, shaped and contoured to receive and conformally and adhesively mate onto and about a large, soft core or other subassembly during compression molding such that the substantially spherical subassembly has a substantially spherical shape after compression molding and is disposed concentrically within the outer layer.

In this embodiment, base 14 contains a lip 16 which is located on an inner surface of base 14 for securing each hemispherical cup 2 within a conventional compression molding process by interlocking with a plate such as disclosed in the Giza patents reference above. Compression molding processes are well known in the golf ball art, for example the '524 and '002 patents, incorporated by reference herein, detail examples of such processes wherein better control of the compression molding process steps occurs. Advantageously, golf balls of the invention can be made using conventional compression molding processes by modifying lip 16 as needed for grasping and holding/securing each hemispherical cup 2 within the conventional compression molding assembly line.

Figure 2:
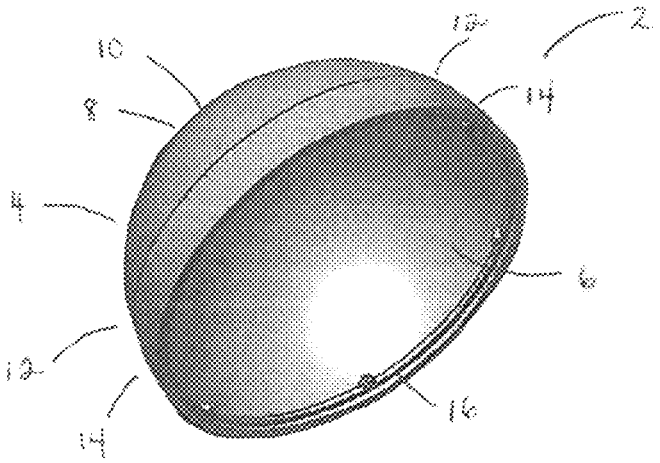
FIG. 2 is an elevated view of the thin hemispherical cup of the invention depicted in the schematic cross-sectional view of FIG. 1.

FIG. 2 depicts an elevated view of one possible hemispherical cup 2 made in accordance with schematic cross-sectional view FIG. 1. Accordingly, consistent with FIG. 1, hemispherical cup 2 of FIG. 2 has: outer surface 4; inner surface 6; top section 8 (located just off center from gate vestige 10 and between outer surface 4 and inner surface 6 and extending circumferentially about gate vestige 10); and bottom section 12 (located just above base 14 and extending between outer surface 4 and inner surface 6 parallel to base 14). As also shown in the schematic cross-sectional view FIG. 1, the top section thickness is 0.083 inches (depicted in FIG. 1 as "0.083 inches"), and the bottom section thickness is 0.055 inches (depicted in FIG. 1 as"0.055 inches"), such that the resulting cup thickness ratio is therefore (0.083/0.055) or 1.5090—well within the range of from about 1.10 to 1.70.

Figure 3A:
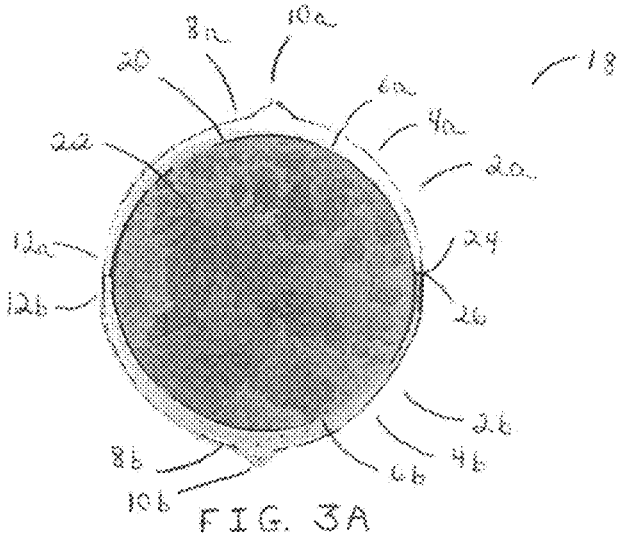
FIG. 3A is a cross-sectional view of the pair of the thin hemispherical cups depicted in FIG. 2 secured about a large soft core prior to compression molding according to one embodiment of the invention.

Meanwhile, FIG. 3A is a cross-sectional view of assembly 18 including thin hemispherical cups 2*a* and 2*b* that are secured about outer surface 20 of large, soft core 22 in advance of the compression molding step. Thin hemispherical cups 2*a* and 2*b* each have outer surfaces 4*a* and 4*b*; inner surfaces 6*a* and 6*b*; top sections 8*a* and 8*b* offset from gate vestiges 10*a* and 10*b*, respectively; and bottom sections 12*a* and 12*b*. Additionally, thin hemispherical cups 2*a* and 2*b* have adjacent surfaces 24, 26 which extend circumferentially about core 22.

Figure 3B:
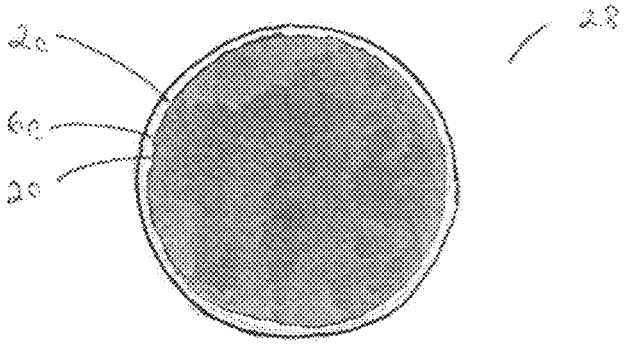
FIG. 3B illustrates a cross-sectional compression molded view of the pair of the thin hemispherical cups and the large soft core depicted in FIG. 3A.

FIG. 3B is a cross-sectional view of FIG. 3A after compression molding. Notably, in finished golf ball 28 of FIG. 3B, thin hemispherical cups 2*a* and 2*b* of FIG 3A have been compression molded into thin uniform outer layer 2*c* onto and about large, soft core 16 at an interface between inner surface 6*c* of thin outer layer 2*c* and core outer surface 20 as well as at mated surfaces 24, 26 without cup shifting or blowout and without creating defects in either layer 2*c* or large, soft core 22. In this embodiment, thin uniform layer 2*c* has a thickness that is less than the bottom section thickness of the thin hemispherical cups 2*a* and schematic cross-sectional view FIG. 1 of FIG. 3A.

However, embodiments are also envisioned wherein the thickness of thin uniform layer 2*c* is greater than the bottom section thickness of the thin hemispherical cups 2*a* and 2*b*. But the thickness of thin uniform layer 2*c* will always be less than the top section thickness of the thin hemispherical cups 2*a* and 2*b* of FIG. 3A. Hemispherical cups 2*a* and 2*b* can be formed via injection molding prior to being compression molded about soft core 22.

In developing golf balls of the invention, numerous hemispherical cup pairs were made having differing configurations and geometries in order to evaluate and observe incidence of blowout when each hemispherical cup pair was compression molded about a large soft polybutadiene core having the same diameter and low compression. All hemispherical cup pairs contained the same material (ionomer blend containing 25 wt % FUSABOND®) and differed only with respect to a wide range of cup thickness ratios falling both within and without the cup thickness ratio range of about 1.10 inches to 1.70.

No blowout (core being crushed) was observed during compression molding when the hemispherical cup pair had a cup thickness ratio in the range of about 1.10 inches to 1.70. In contrast, most cores got crushed (blowout occurred) when the hemispherical cup pair being used had a cup thickness ratio greater than 1.70. Also, hemispherical cup pairs having a cup thickness ratio of less than about 1.10 were not practically compression moldable about the large soft subassembly/core.

Additional trials were then conducted wherein hemispherical cup pairs having a cup thickness ratio range of about 1.10 to 1.70 were compression molded over subassemblies/cores having various other large diameters and low compressions in order to confirm that the cup thickness ratio range of about 1.10 to 1.70 prevents fear of subassembly/core blowout within a wide range of large and soft subassemblies/cores.

It is also possible to create hemispherical cups wherein a thickness ratio of the top section thickness to a uniform thickness of the resulting outer layer of the compression molded first and second hemispherical cups is targeted. A suitable range proved to be 1.3 to 2.7 without meanwhile negatively impacting durability or desired playing characteristics.

Accordingly, fear of blowout is eliminated when compression molding a pair of identical thin hemispherical cups about a large soft core by targeting the construction and geometry of thin hemispherical cups and tapering the thickness of each hemispherical cup from top section to bottom section such that a cup thickness ratio of top section thickness to bottom section thickness was in the range of about 1.10 inches to 1.70 inches. In contrast, blowout is prevalent in comparative golf balls made by compression molding thin hemispherical cup pairs having a cup thickness ratio outside of the range of about 1.10 inches to 1.70 inches about a large soft core.

A finished golf ball of the invention is therefore a different golf ball than conventional golf balls attempted when including conventional hemispherical mold cups. Core shifting and blowout is reliably avoided when the outer layer consists of inventive hemispherical cups having the unique construction and geometry of the thickness tapering from top section to bottom section and a cup thickness ratio of top section thickness to bottom section thickness is in the range of about 1.10 inches to 1.70 about a large, soft subassembly/core as compared with conventional golf balls using conventional hemispherical cups.

In a particular embodiment, the subassembly or core comprises polybutadiene rubber, and each hemispherical cup consists of an ionomer composition comprising at least one of metallocene-catalyzed polyethylenes, functionalized ethylene acrylate copolymers, functionalized ethylene vinyl acetate copolymers, anhydride modified HDPEs, random ethylene copolymers, chemically modified ethylene elastomers, or functionalized polypropylenes in an amount of from about 20 wt. % to about 35 wt. % of the total weight of the ionomer composition.

Many different golf ball constructions can now be made via compression molding cost effectively using materials such as ionomer blends containing 20-35 wt. % FUSABOND® that heretofore were not generally compression moldable as a thin outer layer about a large soft subassembly/core using conventional hemispherical cups without the fear of blowout.

In golf balls of the invention, the core has a large diameter of at least 1.30 inches and a compression of from about 15 to about 60, the thin hemispherical cups may have a cup thickness ratio ranging from about 1.10 inches to 1.70 inches, while the resulting thin outer layer of the finished golf ball may have a uniform compression molded thickness of from about 0.015 inches to about 0.055 inches. In this regard, an additional thickness ratio of top section thickness to resulting outer layer thickness of 1.3 to 2.7 creates additional possible constructions for a golf ball of the invention.

The large subassemblies/cores of golf balls of the invention may have diameters such as 1.3 inches or greater, greater than 1.30 inches, or at least 1.35 inches, or at least 1.40 inches, or at least 1.45 inches, or at least 1.50 inches, or at least 1.55 inches, or at least 1.60 inches, or in the range of from 1.30 inches to about 1.65 inches, or in the range of from 1.30 inches to about 1.55 inches, or in the range of from 1.30 inches to about 1.45 inches, or in the range of from 1.40 inches to about 1.65 inches, or in the range of from 1.40 inches to about 1.55 inches, or in the range of from 1.40 inches to about 1.45 inches, or in the range of from 1.50 inches to about 1.65 inches, or in the range of from about 1.50 inches to about 1.55 inches, or in the range of from about 1.55 inches to about 1.65 inches.

The large subassemblies/cores may meanwhile also have alternative compressions in the range of from about 15 to about 55, or in the range of from about 15 to about 50, or in the range of from about 15 to about 45, or in the range of from about 15 to about 40, or in the range of from about 15 to about 35, or in the range of from about 15 to about 30, or in the range of from about 20 to about 60, or in the range of from about 20 to about 55, or in the range of from about 20 to about 50, or in the range of from about 20 to about 45, or in the range of from about 20 to about 40, or in the range of from about 25 to about 60, or in the range of from about 25 to about 55, or in the range of from about 25 to about 50, or in the range of from about 25 to about 45, or in the range of from about 30 to about 60, or in the range of from about 30 to about 55, or in the range of from about 30 to about 50, or in the range of from about 30 to about 45, or in the range of from about 35 to about 60, or in the range of from about 35 to about 55, or in the range of from about 35 to about 50, or in the range of from about 35 to less than 50, or in the range of from about 35 to about 45, or in the range of from about 40 to about 50, or in the range of from about 40 to less than 50.

It is envisioned that the subassembly of a golf ball of the invention may be a single core or even a multi-layer core. However, in a multi-layer core embodiment, the core must have an outer diameter of at least 1.3 inch, and meanwhile, at least one of the core layers of the subassembly should have a low compression in the range of about 15 to 60.

In some embodiments, the compression molded outer layer may be a cover as well as the outermost layer of the golf ball. In other embodiments, the compression molded outer layer may be a casing layer, inner cover layer and/or other intermediate layer, about which at least one additional layer is formed to complete the golf ball. In this regard, in a particular embodiment, the compression molded outer layer may be an inner cover layer, about which an outer cover layer is formed comprising at least one of a polyurethane composition, polyurea composition, and/or a polyurethane/polyurea hybrid composition is formed.

In some embodiments, the outer layer may have a Shore D hardness of at least 60. In other embodiments, the outer layer may have a Shore D hardness of less than 65. In other embodiments, the hardness of the outer layer may be in the range of from 20 Shore D to less than 65 Shore D, or from about 25 shore D to less than 65 Shore D, or from about 30 Shore D to less than 65 Shore D, or from about 35 Shore D to less than 65 Shore D, or from about 40 Shore D to less than 65 Shore D, or from about 45 Shore D to less than 65 Shore D, or from about 50 Shore D to less than 65 shore D.

Alternatively, the outer layer may have a hardness of greater than 60 Shore D, or 65 Shore D or greater, or greater than 65 Shore D, or greater than 70 shore D.

In a specific embodiment, the subassembly may be a core having a diameter of at least 1.50 inches and a compression of from about 25 to about 60; wherein the outer layer is a cover having a molded thickness of about 0.020 inches to 0.55 inches; and wherein the cup thickness ratio is from about 1.40 to 1.70. In this embodiment, a ratio of the top section thickness to a uniform thickness of the cover may be 1.50 to 2.7.

In another specific embodiment, the core may have a diameter of at least 1.30 inches and a compression of from 25 to 60; with the outer layer being a casing layer having a molded thickness of from 0.015 inches to about 0.055 inches; and wherein the cup thickness ratio is from about 1.10 to 1.70. In this embodiment, a ratio of the top section thickness to a uniform thickness of the casing layer may be 1.30 to 2.5. Also, in this embodiment, the casing layer may be surrounded by one or more intermediate and/or cover layers and/or coating layers.

A particular non-limiting example of the inventive golf balls, hemispherical cup pairs and methods of making such golf balls include thin hemispherical cups containing an ionomer cover composition of 70 wt. % Surlyn® blend combined with 30 wt. % Fusabond®, compression molded about a polybutadiene core having a diameter of 1.590 inches and a compression in the range of about 46. In a specific embodiment, the ionomer composition comprises at least one ethylene-methacrylic acid co-polymer.

FUSABOND® polymers are grafted metallocene-catalyzed polymers, such as those commercially available from E. I. DuPont deNemours & Co. of Wilmington, Del. under the tradenames SURLYN® NMO 525D, SURLYN® NMO 524D, and SURLYN® NMO 499D, all formerly known as the FUSABOND® family of polymers. The FUSABOND® can advantageously increase the maximum initial velocity of the ball, which might have been lowered due to the lower core compression, a decrease in which normally may tend to reduce initial velocity of the ball. A golf ball having a soft outer layer comprised of such as blend has low spin characteristics, because of the large soft core, yet good overall distance, and a good feel when hit with a driver.

Such golf balls can now be made without blowout out of the large, soft core during compression molding due to the inventive configuration and geometry of the hemispherical cups incorporated in the construction of a golf ball of the invention as the thin outer layer. As mentioned further above, blow out typically occurs when compression molding with respect to many if not most of the large soft cores rather than merely in a single or a few incidences. Accordingly, the present invention makes it possible and practical from a cost-savings standpoint to manufacture golf balls having thin outer layers compression molded about large, soft cores.

Additional non-limiting examples of cup thickness ratios (ratio of top section thickness to bottom section thickness) may be in the range of from about 1.10 inches to about 1.60, or from about 1.10 inches to about 1.50, or from about 1.10 inches to about 1.40, or from about 1.10 inches to about 1.30, or from about 1.10 inches to about 1.20, or from about 1.20 inches to 1.70, or from about 1.30 inches to 1.70, or from about 1.40 inches to 1.70, or from about 1.50 inches to 1.70, or from about 1.60 inches to 1.70, or from about 1.20 inches to about 1.60, or from about 1.20 inches to about 1.50, or from about 1.20 inches to about 1.40, or from about 1.20 inches to about 1.30, or from about 1.30 inches to about 1.60, or from about 1.30 inches to about 1.50, or from about 1.30 inches to about 1.40, or from about 1.40 inches to about 1.60, or from about 1.40 inches to about 1.50.

Meanwhile, additional non-limiting examples of thickness ratios (ratio of top section thickness to uniform thickness of the resulting outer layer) may be in the range of from about 1.3 to about 2.7, or from about 1.3 to about 2.6, or from about 1.3 to about 2.5, or from about 1.3 to about 2.4, or from about 1.3 to about 2.3, or from about 1.3 to about 2.2, or from about 1.3 to about 2.1, or from about 1.3 to about 2.0, or from about 1.3 to about 1.9, or from about 1.3 to about 1.8, or from about 1.3 to about 1.7, or from about 1.3 to about 1.6, or from about 1.3 to about 1.5, or from about 1.3 to about 1.4, or from about 1.4 to about 2.7, or from about 1.5 to about 2.7, or from about 1.6 to about 2.7, or from about 1.7 to about 2.7, or from about 1.8 to about 2.7, or from about 1.9 to about 2.7, or from about 2.0 to about 2.7, or from about 2.1 to about 2.7, or from about 2.2 to about 2.7, or from about 2.3 to about 2.7, or from about 2.4 to about 2.7, or from about 2.5 to about 2.7, or from about 2.6 to about 2.7.

The core of a golf ball of the invention can be a wound inner core with a solid or fluid-filled center, but preferably, it is solid. Suitable materials for the core include base rubber materials including resilient polymers such as polybutadiene, natural rubber, polyisoprene, styrene-butadiene, ethylene-propylene-diene rubber, highly neutralized polymers, and combinations thereof. Examples of suitable rubber compounds include polybutadienes made and sold by the Bayer Corporation of Akron, Ohio under the tradenames CB23, CB22, and BR60 and made and sold by the Goodyear Tire and Rubber Company of Akron, Ohio under the tradename 1207G.

In one embodiment, the core is made from a polybutadiene rubber (PBD) that has a mid Mooney viscosity range greater than about 40, more preferably in the range from about 40 to about 80 and more preferably in the range from about 40 to about 60 Mooney. Polybutadiene rubber with higher Mooney viscosity may also be used, so long as the viscosity of the PBD does not reach a level where the high viscosity PBD clogs or otherwise adversely interferes with the manufacturing machinery. It is contemplated that PBD with viscosity less than 65 Mooney can be used with the present invention. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100.degree. C. and rotates at two revolutions per minute. The measurement of Mooney viscosity is defined according to ASTM D-1646.

Golf ball cores made with mid to high Mooney viscosity PBD material exhibit increased resiliency, hence distance, without increasing the hardness of the ball. Such cores are soft, i.e., compression less than about 60 Atti/PGA (the terms "Atti" and "PGA" are used herein interchangeably) and more specifically in the range of about 15-55 PGA, and when these soft cores are incorporated into golf balls such cores generate very low spin and long distance when struck by a driver.

CB 23, which has a Mooney viscosity of about 51 and is a highly linear polybutadiene, is a preferred PBD. If desired, the polybutadiene can also be mixed with other elastomers known in the art, such as natural rubber, various copolymers comprising styrene and butadiene, and/or polymers comprising isoprene, such as trans-isoprene, in order to further modify the properties of the inner core. When a mixture of elastomers is used, the amounts of other constituents in the inner core composition are typically based on 100 parts by weight of the total elastomer mixture.

Other suitable core materials including thermosetting polymers, such as natural rubber, other grades of polybutadiene, polyisoprene, styrene-butadiene or styrene-propylene-diene rubber, and thermoplastics such as ionomer resins, polyamides, polyesters, or a thermoplastic elastomer. Suitable thermoplastic elastomers include Pebax®, which is believed to comprise polyether amide copolymers, Hytrel®, which is believed to comprise polyether ester copolymers, thermoplastic urethane, and Kraton®, which is believed to comprise styrenic block copolymers elastomers. These products are commercially available from Elf-Atochem, E.I. Du Pont de Nemours and Company, various manufacturers, and Shell Chemical Company, respectively. The inner core materials can also be formed from a partially or fully neutralized ionomer, a metallocene or other single-site catalyzed polymer or a castable thermosetting or thermoplastic material. Suitable castable materials include those comprising a polyurethane, polyurea, epoxy, silicone, IPN's, etc. Golf ball inner cores made with these inner core materials have a PGA compression of preferably less than 90, more preferably less than 80 and most preferably less than 70.

Additionally, other suitable core materials are disclosed in U.S. Pat. No. 5,919,100 and international publications WO 00/23519 and WO 01/29129. These disclosures are incorporated by reference herein in their entireties. One particularly suitable material disclosed in WO/29129 is a melt processible composition comprising a highly neutralized ethylene copolymer and one or more aliphatic, mono-functional organic acids having fewer than 36 carbon atoms of salts thereof, wherein greater than 90% of all the acid of the ethylene copolymer is neutralized.

The core may also include a cross-linking agent, a cross-linking aid or activator, a weight or density adjusting additive and a free radical initiator. The use of cross-linking agents in golf ball cores is known in the art. Suitable cross-linking agents include the reaction product of an unsaturated carboxylic acid or acids and an oxide or carbonate of a metal such as zinc, magnesium, barium, calcium, lithium, sodium, potassium, cadmium, lead, tin and the like. For example, the unsaturated carboxylic acids include .alpha.- or .beta.-ethylenic unsaturated acids such as acrylic acid, methacrylic acid, itaconic acid, crotonic acid, sorbic acid and mixtures thereof. The unsaturated carboxylic acids and metal salts thereof are generally soluble in the elastomeric base, or are readily dispersible. For example, metal salt diacrylates, dimethacrylates, or mono(meth)acrylates are preferred for use in the golf ball cores of the present invention, and zinc diacrylate is a particularly preferred cross-linking agent. Other metal salt di- or mono-(meth) acrylates suitable for use in the present invention include those in which the metal is calcium or magnesium.

The core can also include a cross-linking activator to promote sufficient cross-linking of the base rubber material. A suitable cross-linking activator is zinc oxide. Zinc oxide can also be used as a weight adjusting filler and to achieve a higher coefficient of restitution. Additional processing aids such as dispersants and activators may optionally be included. In particular, zinc stearate may be added as a processing aid (e.g. as an activator). Any of a number of specific gravity adjusting fillers may be included to obtain a preferred total weight of the core. Examples of such fillers include tungsten and barium sulfate. Preferably, the specific gravity adjusting filler is tungsten.

A free radical initiator is included in the core to promote cross-linking of the base rubber material and the cross-linking agent. The free radical initiator promotes cross-linking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Preferably, the peroxide is an organic peroxide. Suitable peroxides include dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like and mixtures thereof. In one embodiment, the free radical initiator is Trigonox®, which is commercially available from Akzo Nobel Chemicals B.V. of Amersfoort, The Netherlands. The total amount of initiators used will vary depending on the specific end product desired and the particular initiators employed.

Other useful initiators would be readily apparent to one of ordinary skill in the art without any need for undue experimentation. The initiator(s) at about 40% to about 100% activity are preferably added in an amount ranging between about 0.05 pph and about 5 pph based upon 100 parts of polybutadiene, or polybutadiene mixed with one or more other elastomers. More preferably, the amount of initiator added ranges between about 0.15 pph to about 2 pph and most preferably between about 0.25 pph to about 1.5 pph. Suitable commercially available dicumyl peroxides include Perkadox BC, which is a 90% active dicumyl peroxide, and DCP 70, which is a 70% active dicumyl peroxide.

Golf balls constructed in accordance with the present invention may be substantially free of halogenated organo-sulfur compounds, including organic compounds wherein at least one sulfur compound is added to the material, that are typically added to golf ball inner cores to increase the resiliency and the coefficient of restitution of the ball. Examples of these halogenated organo-sulfur compounds include, but are not limited to, pentachlorothiophenol (PCTP) and salts of PCTP such as ZnPCTP.

It is envisioned that the subassembly/core of a golf ball of the invention may alternatively or additionally comprise any composition or material that would be vulnerable to blowout when a pair of conventional hemispherical cups are compression molded thereabout.

It is also envisioned golf ball of the invention may have any number of layers, for example, in one embodiment the golf ball may be a four piece ball comprising an inner core surrounded by an outer core layer that is in contact with a very thin third layer (constructed of the inventive hemispherical cups), which is in turn surrounded by an outermost cover layer. In one such embodiment, the combined thickness of the inner core and outer core layer could be at least about 1.50 inches, while the very thin third layer is only about 0.015 inches thick. The third layer may have a Shore D hardness of from about 60 or higher, or about 65 or higher.

The fourth outermost layer in such an embodiment may have a thickness that is less than about 0.045 inches and preferably less than about 0.035 inches and may have a shore D hardness of from about 62 or less and preferably about 55 or less. These materials include materials commonly known to those of skill in the art. Preferably, the material includes polyurethane, polyurea, or a combination thereof. The outermost layer in this embodiment may be formed with a plurality of dimples or surface protrusions defined on the outer surface thereof, and the polymer forming the outer cover may include fillers embedded in a polymeric matrix or binder Covers of golf balls of the invention may have one or more layers. The golf ball of this invention may have single-, dual-, or multi-layered covers preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In one embodiment, the cover is a single layer having a thickness of from 0.025 inches to 0.035 inches.

The cover material should impart durability, toughness and tear-resistance to the ball. For example, polyurethane/polyurea compositions can be used in the cover layer, because they can provide the cover with high durability as well as a soft feel. In other embodiments, the cover may be made of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

In one embodiment, ionomer resins can be used as the cover material. These cross-linked polymers contain interchain ionic bonding as well as covalent bonding. The ionomer resins include, for example, a copolymer of ethylene and an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn® (DuPont) and Escor.® and Iotek® (Exxon). These ionomer resins are available in various grades and are identified based on the type of base resin, molecular weight, type of metal ion, amount of acid, degree of neutralization, additives, and other properties.

Non-limiting examples of suitable ionomers include partially neutralized ionomers, blends of two or more partially neutralized ionomers, highly neutralized ionomers, blends of two or more highly neutralized ionomers, and blends of one or more partially neutralized ionomers with one or more highly neutralized ionomers. Methods of preparing ionomers are well known, and are disclosed, for example, in U.S. Pat. No. 3,264,272, the entire disclosure of which is hereby incorporated herein by reference. The acid copolymer can be a direct copolymer wherein the polymer is polymerized by adding all monomers simultaneously, as disclosed, for example, in U.S. Pat. No. 4,351,931, the entire disclosure of which is hereby incorporated herein by reference. Alternatively, the acid copolymer can be a graft copolymer wherein a monomer is grafted onto an existing polymer, as disclosed, for example, in U.S. Patent Application Publication No. 2002/0013413, the entire disclosure of which is hereby incorporated herein by reference.

Examples of suitable partially neutralized acid polymers include, but are not limited to, Surlyn® ionomers, commercially available from E. I. du Pont de Nemours and Company; AClyn® ionomers, commercially available from Honeywell International Inc.; and Iotek® ionomers, commercially available from Exxon Mobil Chemical Company. Some suitable examples of highly neutralized ionomers (HNP) are DuPont® HPF 1000 and DuPont® HPF 2000, ionomeric materials commercially available from E. I. du Pont de Nemours and Company. In some embodiments, very low modulus ionomer- ("VLMI-") type ethylene-acid polymers are particularly suitable for forming the HNP, such as Surlyn® 6320, Surlyn® 8120, Surlyn® 8320, and Surlyn® 9320, commercially available from E. I. du Pont de Nemours and Company.

At least one layer of a golf ball of the invention may be formed from ionomeric materials including blends of ionomers such as blends of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may also be neutralized. The second polymer component, which may be partially or fully neutralized, may comprise for example ionomeric copolymers and terpolymers, ionomer precursors, thermoplastics, polyamides, polycarbonates, polyesters, polyurethanes, polyureas, polyurethane/urea hybrids, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

Additional suitable materials for golf ball layers include polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

Thus, in one embodiment, the cover is a single layer formed from a composition selected from the group consisting of ionomers, polyester elastomers, polyamide elastomers, and combinations of two or more thereof. In a second embodiment, the cover may comprise a composition formed from a thermoplastic polyurethane, thermoset polyurethane, thermoplastic polyurea, or thermoset polyurea. In another version, the cover layer comprises a blend of from about 10% to about 90% by weight of the polyurea composition and from about 90% to about 10% of a polyurethane composition. In yet another embodiment, the cover layer comprises a blend of from about 10% to about 90% by weight of the polyurea composition and from about 90% to about 10% of another polymer or other material such as vinyl resins, polyesters, polyamides, and polyolefins.

When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions that can be used include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, that is, as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(.beta.-hydroxyethyl)ether; hydroquinone-di-(.beta.-hydroxyethyl)ether; trimethylol propane; and combinations thereof.

Suitable polyurethane cover compositions also include those formed from the reaction product of at least one isocyanate and at least one curing agent or the reaction product of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The cover composition is not limited by the use of a particular polyisocyanate. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("H.sub.12MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate may have less than 14% unreacted NCO groups. Preferably, the at least one polyisocyanate has no greater than 8.5% NCO, more preferably from 2.5% to 8.0%, or from 4.0% to 7.2%, or from 5.0% to 6.5%.

The cover composition is not limited by the use of a particular polyol. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a pre-polymer method. In this method, the polyisocyanate and the polyol are mixed separately prior to addition of the curing agent. This method affords a more homogeneous mixture resulting in a more consistent polymer composition.

In the casting process, the polyurea and polyurea/urethane compositions can be formed by chain-extending the polyurea prepolymer with a single curing agent or blend of curing agents as described further below. The compositions of the present invention may be selected from among both castable thermoplastic and thermoset materials. Thermoplastic polyurea compositions are typically formed by reacting the isocyanate blend and polyamines at a 1:1 stoichiometric ratio. Thermoset compositions, on the other hand, are cross-linked polymers and are typically produced from the reaction of the isocyanate blend and polyamines at normally a 1.05:1 stoichiometric ratio. In general, thermoset polyurea compositions are easier to prepare than thermoplastic polyureas.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

When injection molding is used to form a golf ball layer, the layer composition is typically in a pelletized or granulated form that can be easily fed into the throat of an injection molding machine wherein it is melted and conveyed via a screw in a heated barrel at temperatures of from about 150° F. to about 600° F., preferably from about 200° F. to about 500° F. The molten composition is ultimately injected into a closed mold cavity, which may be cooled, at ambient or at an elevated temperature, but typically the mold is cooled to a temperature of from about 50° F. to about 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

Castable reactive liquid polyurethanes and polyurea materials may be applied over the inner ball using a variety of application techniques such as casting, injection molding spraying, compression molding, dipping, spin coating, or flow coating methods that are well known in the art. In one embodiment, the castable reactive polyurethanes and polyurea material is formed over the core using a combination of casting and compression molding. Conventionally, compression molding and injection molding are applied to thermoplastic cover materials, whereas RIM, liquid injection molding, and casting are employed on thermoset cover materials.

U.S. Pat. No. 5,733,428, the entire disclosure of which is hereby incorporated by reference, discloses a method for forming a polyurethane cover on a golf ball core. Because this method relates to the use of both casting thermosetting and thermoplastic material as the golf ball cover, wherein the cover is formed around the core by mixing and introducing the material in mold halves, the polyurea compositions may also be used employing the same casting process.

For example, once a polyurea composition is mixed, an exothermic reaction commences and continues until the material is solidified around the core. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urea mix for introducing cores into the mold halves is determined to be approximately between about 2,000 cP and about 30,000 cP, or within a range of about 8,000 cP to about 15,000 cP.

To start the cover formation, mixing of the prepolymer and curative is accomplished in a motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 100 seconds, preferably for about 70 to about 80 seconds, a core is lowered at a controlled speed into the gelling reacting mixture.

A ball cup holds the shell through reduced pressure (or partial vacuum). Upon location of the core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurea prepolymer and curing agent introduced therein to commence gelling.

Similarly, U.S. Pat. No. 5,006,297 and U.S. Pat. No. 5,334,673 both also disclose suitable molding techniques that may be utilized to apply the castable reactive liquids employed in the present invention. However, it is envisioned that layers of golf balls of the invention other than the thin outer layer (consisting of the inventive hemispherical cups) may be made by any known technique to those skilled in the art.

Examples of yet other materials which may be suitable for incorporating and coordinating in order to target and achieve desired playing characteristics or feel include plasticized thermoplastics, polyalkenamer compositions, polyester-based thermoplastic elastomers containing plasticizers, transparent or plasticized polyamides, thiolene compositions, poly-amide and anhydride-modified polyolefins, organic acid-modified polymers, and the like.

Cover compositions may also include one or more filler (s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Several suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

While the thin outer layer is formed about the subassembly/core in a golf ball of the invention using heat-induced compression molding, other golf ball layers of golf balls of the invention may be formed in some embodiments using a variety of application techniques. For example, at least some of the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

It is envisioned that golf balls of the invention may also incorporate conventional coating layer(s) for the purposes usually incorporated. For example, one or more coating layer may have a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example. Coating layers may be an outermost golf ball layer and is also or alternatively sometimes used as a moisture barrier layer or even a tie layer for improving adhesion between two other adjacent layers.

The "compression" of the golf ball and its components such as the soft core is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

The cover hardness may also be targeted depending on desired playing characteristics. As a general rule, all other things being equal, a golf ball having a relatively soft cover will spin more than a similarly constructed ball having a harder cover. The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

Thermoset and thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

In a golf ball if the invention, Coefficient of Restitution or CoR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. CoR is then calculated as the ratio of the outgoing transit time period to the incoming transit time period, $CoR=V_{out}/V_{in}=T_{in}/T_{out}$. The CoR value can be targeted, for example, by varying the core peroxide and antioxidant types and amounts as well as the cure temperature and duration.

The present invention contemplates golf balls having CoRs of at least about 0.700 at an inbound velocity of about 125 ft/sec, or from about 0.700 to about 0.850 at an inbound velocity of about 125 ft/sec. In one embodiment, the CoR is from about 0.750 to about 0.800, or from about 0.760 to about 0.790, or from about 0.770 to about 0.780. In another embodiment, the ball has a CoR of about 0.800 or greater. In yet another embodiment, the CoR of a golf ball of the invention may be from about 0.800 to about 0.815.

In a particular embodiment, the core has a CoR of at least 0.780, or from about 0.780 to about 0.7950. However, the CoR of the core can alternatively be targeted such that the finished golf ball has a CoR such as those disclosed above as long as the diameter of the core is large as disclosed herein and the compression of the core is low as also disclosed herein.

Golf balls of the present invention preferably have a moment of inertia ("MOI") of 70-95 $g\cdot cm^2$, preferably 75-93 $g\cdot cm^2$, and more preferably 76-90 $g\cdot cm^2$. For low MOI embodiments, the golf ball preferably has an MOI of 85 $g\cdot cm^2$ or less, or 83 $g\cdot cm^2$ or less. For high MOI embodiment, the golf ball preferably has an MOI of 86 $g\cdot cm^2$ or greater, or 87 $g\cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

It is understood that the golf balls of the invention incorporating first and second hemispherical cups compression molded about a large, soft core, as described and illustrated herein represent only some of the many embodiments of the invention. It is appreciated by those skilled in the art that various changes and additions can be made to such golf balls without departing from the spirit and scope of this invention. It is intended that all such embodiments be covered by the appended claims.

A golf ball of the invention may further incorporate indicia, which as used herein, is considered to mean any symbol, letter, group of letters, design, or the like, that can be added to the dimpled surface of a golf ball.

Golf balls of the present invention will typically have dimple coverage of 60% or greater, preferably 65% or greater, and more preferably 75% or greater. It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any of these embodiments the single-layer core may be replaced with a two or more layer core wherein at least one core layer has a hardness gradient.

Embodiments are envisioned wherein in a golf ball of the invention, thin outer layer, compression molded about the large soft core, provides improved protection against moisture penetration into the core because the inventive hemispherical cups comprise a material that imparts such protection yet is still compression moldable in a thin outer layer about the core.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the golf ball of the invention has been described herein with reference to particular means and materials, it is to be understood that the invention is not limited to the particulars disclosed and extends to all equivalents within the scope of the claims.

What is claimed is:

1. A golf ball having a CoR of at least 0.700 and comprising:

a substantially spherical subassembly having a diameter of 1.30 inches or greater and a compression of from about 15 to about 60; and an outer layer having a compression molded thickness of from about 0.015 inches to about 0.055 inches and consisting of first and second hemispherical cups that are compression molded about the substantially spherical subassembly;

wherein each hemispherical cup consists of a polymer composition having a melt flow index at 190° C. under a 2.16-kg load of from about 0.8 g/10 min. to about 4 g/10 min. and has:

(i) a thickness that tapers from a top section to a bottom section such that a cup thickness ratio of a top section thickness to a bottom section thickness is from about 1.10 to 1.70; and (ii) an inner surface that is sized, shaped and contoured to receive and conformally and adhesively mate onto and about the subassembly during compression molding such that the substantially spherical subassembly has a substantially spherical shape after compression molding and is disposed concentrically within the outer layer.

2. The golf ball of claim 1, wherein the subassembly comprises polybutadiene rubber; and the polymer composition consists of an ionomer composition comprising at least one of metallocene-catalyzed polyethylenes, functionalized ethylene acrylate copolymers, functionalized ethylene vinyl acetate copolymers, anhydride modified HDPEs, random ethylene copolymers, chemically modified ethylene elastomers, or functionalized polypropylenes in an amount of from about 20 wt. % to about 35 wt. % of the total weight of the ionomer composition.

3. The golf ball of claim 2, wherein the subassembly is a core having a diameter of at least 1.50 inches and a compression of from about 25 to about 60; and wherein the outer layer is a cover having a compression molded thickness of from about 0.020 inches to about 0.55 inches; and the cup thickness ratio is from about 1.40 to 1.70.

4. The golf ball of claim 3, wherein a ratio of the top section thickness to a uniform thickness of the cover is 1.50 to 2.7.

5. The golf ball of claim 2, wherein the core has a diameter of at least 1.30 inches and a compression of from 25 to 60; and wherein the outer layer is a casing layer having a molded thickness of from 0.015 inches to about 0.055 inches.

6. The golf ball of claim 5, wherein a ratio of the top section thickness to a uniform thickness of the casing layer is 1.30 to 2.5.

7. The golf ball of claim 2, wherein the outer layer has a Shore D hardness of at least 60.

8. The golf ball of claim 2, wherein the outer layer has a Shore D hardness of less than 65.

9. The golf ball of claim 2, wherein the ionomer composition comprises at least one ethylene-methacrylic acid copolymer.

10. The golf ball of claim 2, wherein the subassembly is a core having a diameter of at least 1.50 inches.

11. A golf ball subassembly made of first and second hemispherical cups consisting of a polymer composition having a melt flow index at 190° C. under a 2.16-kg load of from about 0.8 g/10 min. to about 4 g/10 min. and each hemispherical cup having:

(i) a cup thickness that tapers from a top section to a bottom section such that a cup thickness ratio of a top section thickness to a bottom section thickness is from about 1.10 to 1.70; and (ii) an inner surface that is sized, shaped, and contoured to receive an conformally and adhesively compression mold onto and about a substantially spherical subassembly having a diameter of at least 1.3 inches and a compression of from about 15 to about 60 such that the subassembly retains its substantially spherical shape after the first and second hemispherical cups are compression molded there about and is disposed concentrically within the compression molded first and second hemispherical cups.

12. The first and second hemispherical cups of claim 11, wherein the polymer composition consists of an ionomer composition comprising at least one of metallocene-catalyzed polyethylenes, functionalized ethylene acrylate copolymers, functionalized ethylene vinyl acetate copolymers, anhydride modified HDPEs, random ethylene copolymers, chemically modified ethylene elastomers, or functionalized polypropylenes in an amount of from about 20 wt. % to about 35 wt. % of the total weight of the ionomer composition.

13. The first and second hemispherical cups of claim 12, wherein a ratio of the top section thickness to a uniform thickness of the compression molded first and second hemispherical cups is 1.50 to 2.7.

14. The first and second hemispherical cups of claim 12, wherein a ratio of the top section thickness to a uniform thickness of the compression molded first and second hemispherical cups is 1.3 to 2.5.

15. The first and second hemispherical cups of claim 12, having a Shore D hardness of at least 60.

16. The first and second hemispherical cups of claim 12, having a Shore D hardness of 65 or less.

17. The first and second hemispherical cups of claim 12, wherein the ionomer composition comprises at least one ethylene-methacrylic acid co-polymer.

18. A method of making a golf ball having a CoR of at least 0.700 and comprising the steps of:

(a) providing a substantially spherical subassembly having a diameter of at least 1.30 inches and a compression of from about 15 to about 60;

(b) providing first and second hemispherical cups consisting of a polymer composition having a melt flow index at 190° C. under a 2.16-kg load of from about 0.8 g/10 min. to about 4 g/10 min. and each hemispherical cup having:

(i) a thickness that tapers from a top section to a bottom section such that a cup thickness ratio of a top section thickness to a bottom section thickness is from about 1.10 to 1.70; and (ii) an inner surface that is sized, shaped and contoured to receive and conformally and adhesively mate onto and about the subassembly during compression molding such that the substantially spherical subassembly has a substantially spherical shape after compression molding and is disposed concentrically within the outer layer; and (c) compression molding the first and second hemispherical cups about the substantially spherical subassembly and forming an outer layer there about having a compression molded thickness of from about 0.015 inches to about 0.055 inches.

19. The method of making a golf ball of claim 18, wherein the subassembly comprises polybutadiene rubber; and the polymer composition consists of an ionomer composition comprising at least one of metallocene-catalyzed polyethylenes, functionalized ethylene acrylate copolymers, functionalized ethylene vinyl acetate copolymers, anhydride modified HDPEs, random ethylene copolymers, chemically modified ethylene elastomers, or functionalized polypropylenes in an amount of from about 20 wt. % to about 35 wt. % of the total weight of the ionomer composition.

20. The method of making a golf ball of claim 19, wherein the subassembly is a core having a diameter of at least 1.50 inches and a compression of from about 25 to about 60; and wherein the outer layer is a cover having a molded thickness of about 0.020 inches to 0.55 inches; and the cup thickness ratio is from about 1.40 to 1.70.

21. The method of making a golf ball of claim 20, wherein a ratio of the top section thickness to a uniform thickness of the cover is 1.50 to 2.7.

22. The method of making a golf ball of claim 19, wherein the core has a diameter of at least 1.30 inches and a compression of from 25 to 60; and wherein the outer layer is a casing layer having a molded thickness of from 0.015 inches to about 0.055 inches.

23. The method of making golf ball of claim 22, wherein a ratio of the top section thickness to a uniform thickness of the casing layer is 1.30 to 2.5.

24. The method of making golf ball of claim 19, wherein the outer layer has a Shore D hardness of at least 60.

25. The method of making golf ball of claim 19, wherein the outer layer has a Shore D hardness of less than 65.

26. The method of making golf ball of claim 19, wherein the ionomer composition comprises at least one ethylene-methacrylic acid co-polymer.

* * * * *